US008642862B1

(12) United States Patent
Baird

(10) Patent No.: US 8,642,862 B1
(45) Date of Patent: Feb. 4, 2014

(54) MECHANICAL PITCH SHIFTER

(76) Inventor: Derrick Lynn Baird, Norris, TN (US)

( * ) Notice: Subject to any disclaimer, the term of this patent is extended or adjusted under 35 U.S.C. 154(b) by 44 days.

(21) Appl. No.: 13/341,925

(22) Filed: Dec. 31, 2011

Related U.S. Application Data

(60) Provisional application No. 61/460,494, filed on Jan. 3, 2011.

(51) Int. Cl.
*G10D 3/00* (2006.01)

(52) U.S. Cl.
USPC ..... 84/315; 84/318

(58) Field of Classification Search
USPC ..... 84/315, 318
See application file for complete search history.

(56) References Cited

U.S. PATENT DOCUMENTS

| | | | | | |
|---|---|---|---|---|---|
| 3,000,253 | A | * | 9/1961 | Houde | 84/312 R |
| 3,704,646 | A | * | 12/1972 | Davis et al. | 84/454 |
| 3,818,793 | A | * | 6/1974 | Round | 84/454 |
| 4,104,947 | A | * | 8/1978 | Oster | 84/318 |
| D257,988 | S | * | 1/1981 | Nakamoto | D17/20 |
| 4,319,512 | A | * | 3/1982 | Clyburn | 84/318 |
| 4,334,457 | A | * | 6/1982 | Spoonts, III | 84/318 |
| 4,643,069 | A | | 2/1987 | Borisoff | |
| 4,926,732 | A | * | 5/1990 | Collins et al. | 84/318 |
| 5,287,788 | A | * | 2/1994 | Hill, Jr. | 84/315 |
| 5,542,330 | A | | 8/1996 | Borisoff | |
| 5,623,110 | A | * | 4/1997 | Hoglund et al. | 84/318 |
| 5,747,713 | A | * | 5/1998 | Clement | 84/313 |
| 6,023,014 | A | | 2/2000 | Sperzel | |
| 7,109,405 | B2 | * | 9/2006 | Brown | 84/318 |
| 7,183,475 | B2 | | 2/2007 | Van Halen | |
| 7,329,808 | B2 | * | 2/2008 | Davis | 84/313 |
| 7,446,248 | B2 | | 11/2008 | Skinn | |
| 7,550,661 | B1 | * | 6/2009 | Willis | 84/318 |
| 7,557,285 | B2 | * | 7/2009 | Ward | 84/422.1 |
| 7,563,969 | B2 | * | 7/2009 | Einhorn et al. | 84/318 |
| 7,935,876 | B1 | | 5/2011 | West | |
| 8,110,733 | B2 | * | 2/2012 | D'Arco | 84/454 |
| 2006/0042452 | A1 | * | 3/2006 | Brown | 84/455 |
| 2013/0118334 | A1 | * | 5/2013 | Stenbroten | 84/318 |

OTHER PUBLICATIONS

Bob Kerr, D-Tuner Interview Transcript with Bill Keith, potions published in Banjo Newsletter vol. XXVIII No. 10 Aug. 2001, transcript found at http://www.beaconbanjo.com/story.cfm, Beacon Banjo Company, Inc. Woodstock, NY.

* cited by examiner

*Primary Examiner* — Elvin G. Enad
*Assistant Examiner* — Robert W Horn

(57) ABSTRACT

A mechanical pitch shifter for changing the pitch of a stringed musical instrument is disclosed. The mechanical pitch shifter engages the musical instrument string between the end of operational length and point of string termination. This device comprises a base clamp 1 and thumbscrew 2 to attach to the musical instrument. This devise comprises a top bar 6 and cam 8 to engage and disengage the musical instrument string. Reaction force of the string is opposed by the thumbscrew 2. Fine tuning of the string pitch is achieved by turning a thumbwheel 3 thus changing the displacement between top bar 6 and base clamp 1.

8 Claims, 4 Drawing Sheets

MECHANICAL PITCH SHIFTER

CROSS-REFERENCE TO RELATED APPLICATIONS

This application claims the benefit of provisional patent application Ser. No. 61/460,494 filed 2011 Jan. 3 by present inventor.

BACKGROUND

In various applications, stringed musical instruments may need to change the pitch of a string. For example, the pitch of the low E string of a guitar can change from E to D. This allows two different popular guitar tunings, standard tuning and drop D tuning. The guitar player is required to tune the guitar manually with the provided tuning peg to accomplish this task. Some guitarist will have two guitars tuned to these tunings so as to not do this task during a performance. The guitarist can also permanently replace tuning pegs that can go between two different pitches. On some bridges, an accessory can be installed on the guitar to accomplish the change in pitch.

These alternatives have disadvantages. The first is having to change guitars during a performance. This is a disadvantage because the extra guitar is another item subject to theft for a small club type musician. It is also another item that must be transported to the venue. The second alternative is having to apply an expensive permanent modification the guitar. This type modification is not acceptable on most vintage musical instruments as it lowers the value. U.S. Pat. No. 7,550,661 to Willis (2007) discloses a string deflector for a banjo. This deflector is designed for permanent attachment to the musical instrument. It is shown screwed into the wood to resist the shearing force opposing the string deflection. This attachment is not suitable for valuable vintage instruments. This deflector is also comprised of flexible members. These members would be a source of unwanted buzz when left in loose contact with the banjo string.

The most commercially available way of pitch change is with special string tuners. U.S. Pat. No. 4,643,069 to Borisoff (1985) shows a tuning machine that will change the tension in a string by motion of a lever. These tuners require a permanent modification to the musical instrument to be installed. U.S. Pat. No. 7,183,475 to Van Halen (2007) shows a device that is also commercially available. This device as shown requires replacement of the bridge on each musical instrument. In the market this device is only made to work with an existing bridge of a "Floyd Rose" type. Another disadvantage is a separate hex wrench is needed to adjust the tuning.

SUMMARY

An embodiment of the present invention addresses these issues and others by providing a mechanical pitch shifter. One example of a mechanical pitch shifter uses a base clamp and top bar acted on by a cam to apply a force to a musical instrument string. The mechanical pitch shifter locates between the standard tuner and the nut. The bottom clamp with attached thumbscrew attaches to a musical instrument headstock. The cam engages the top bar that applies force to the musical instrument string. The reaction force is transferred from the threaded rod going through a shaft in the cam to the bottom clamp by a thumbwheel. Motion of the cam allows for change of the string pitch. The thumbwheel allows for fine-tuning the pitch by adjusting the top bar displacement.

DRAWINGS

Reference Numerals

Figure 1:
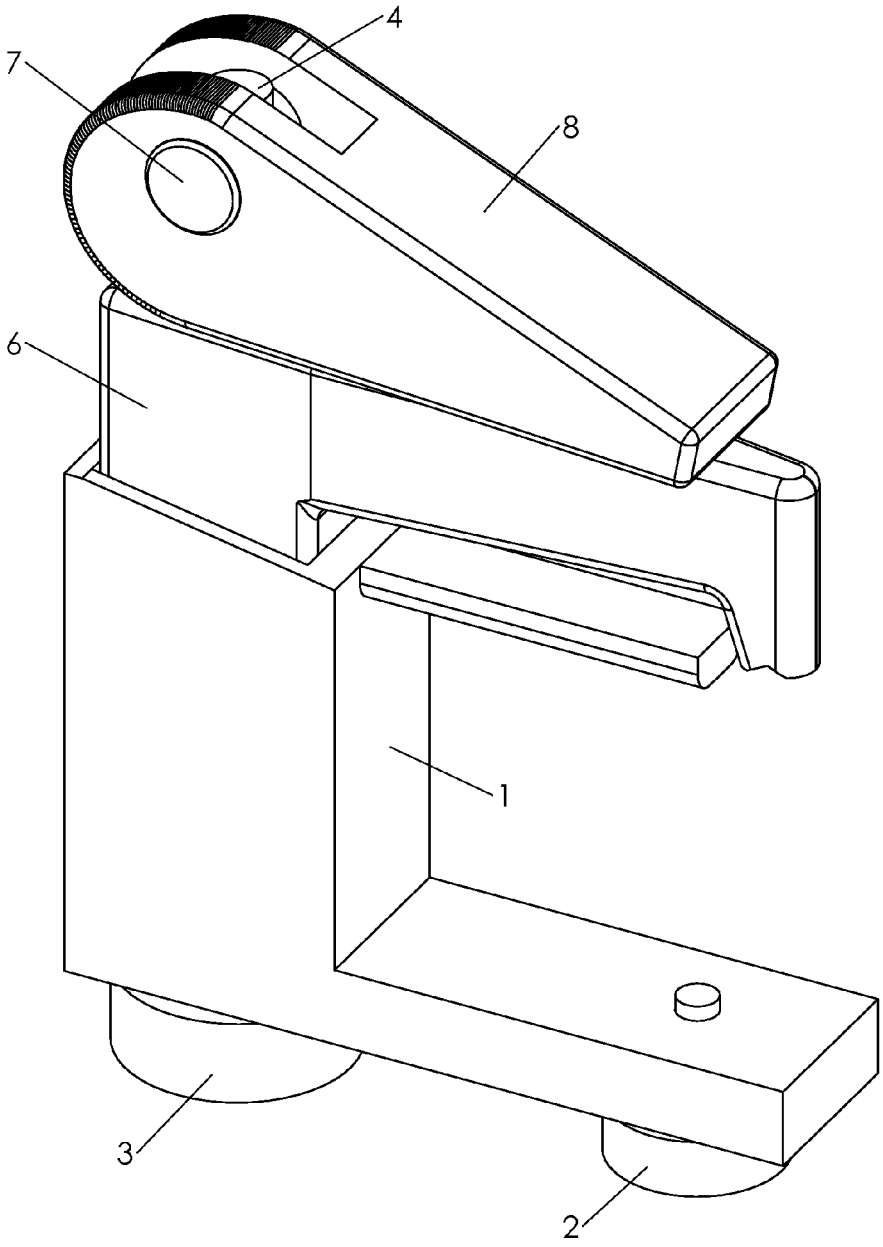
FIG. 1 is a perspective view of a mechanical pitch shifter according to the preferred embodiment.

1 base clamp
2 thumbscrew
3 thumbwheel
4 threaded rod
5 spring
6 top bar
7 cam shaft
8 cam
9 string
10 headstock

DETAILED DESCRIPTION

Figure 2:
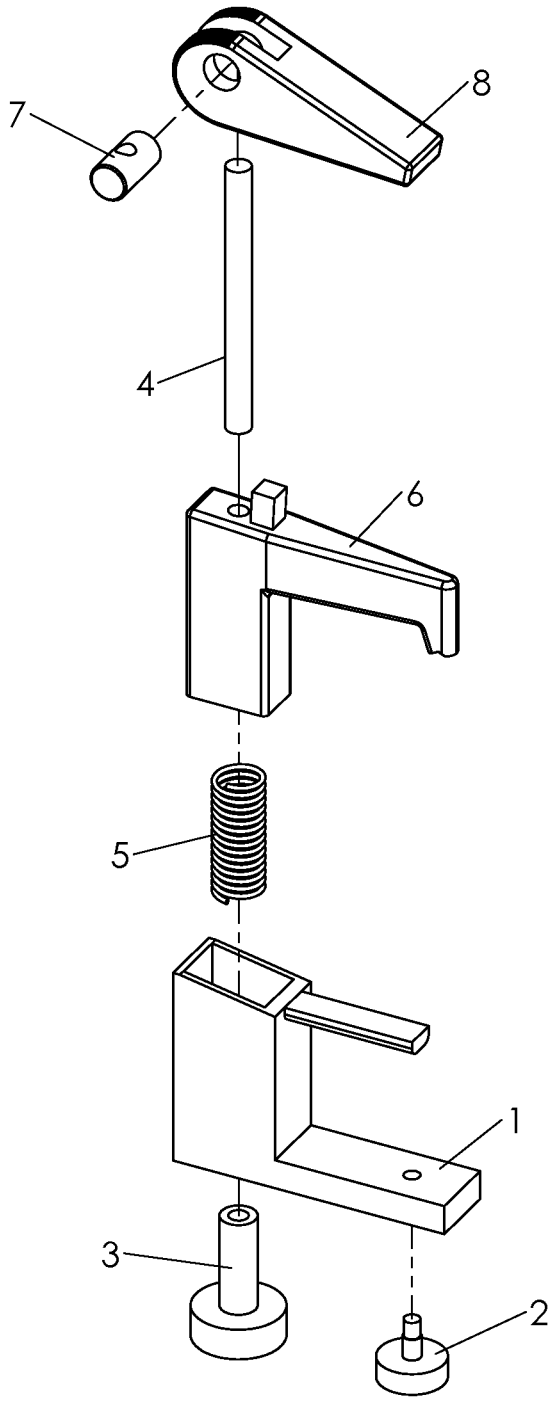
FIG. 2 is an exploded assembly of the embodiment in FIG. 1.

FIG. 1 and FIG. 2 are perspective views according to the preferred embodiment of a mechanical pitch shifter. FIG. 2 is an exploded assembly to show all the components. The mechanical pitch shifter has a base clamp 1 with a boss at its top. A thumbscrew 2 is threaded into the bottom of base clamp 1. Thumbscrew 2 and the boss of base clamp 1 form an adjustable clamp.

A thumbwheel 3 bears on the bottom of base clamp 1. The shaft of thumbwheel 3 passes through the hole in the bottom of base clamp 1. A threaded rod 4 is threaded into thumbwheel 3. A spring 5 is concentric to the shaft of thumbwheel 3 and is inside a cavity of base clamp 1. Spring 5 is in contact with the bottom of the cavity of base clamp 1 and the bottom of a top bar 6. Top bar 6 compresses spring 5 and fits closely to the inside of the cavity of base clamp 1. Threaded rod 4 passes through top bar 6 and threads into a cam shaft 7. Cam shaft 7 resides inside a hole in a cam 8. Cam 8 bears on the top of top bar 6. The boss on top of top bar 6 is located between the slot of cam 8. This boss is provided to prevent rotation of the cam about the axis of threaded rod 4.

Figure 3:
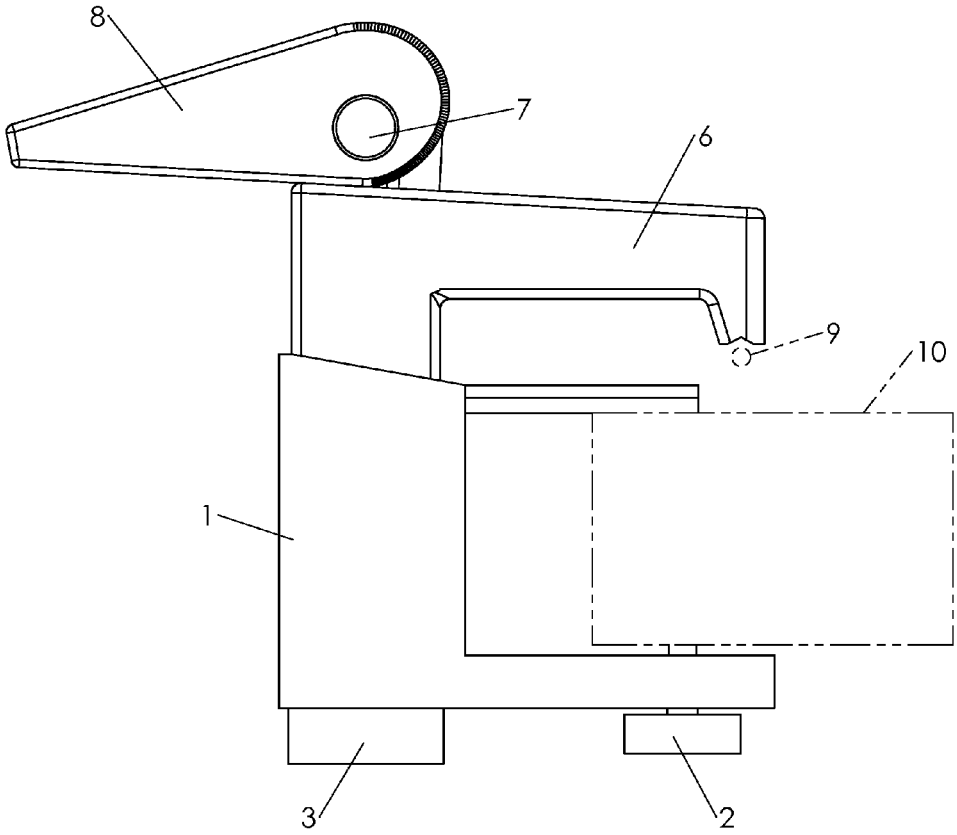
FIG. 3 is a front view of the embodiment in FIG. 1 attached to a musical instrument.
Figure 4:
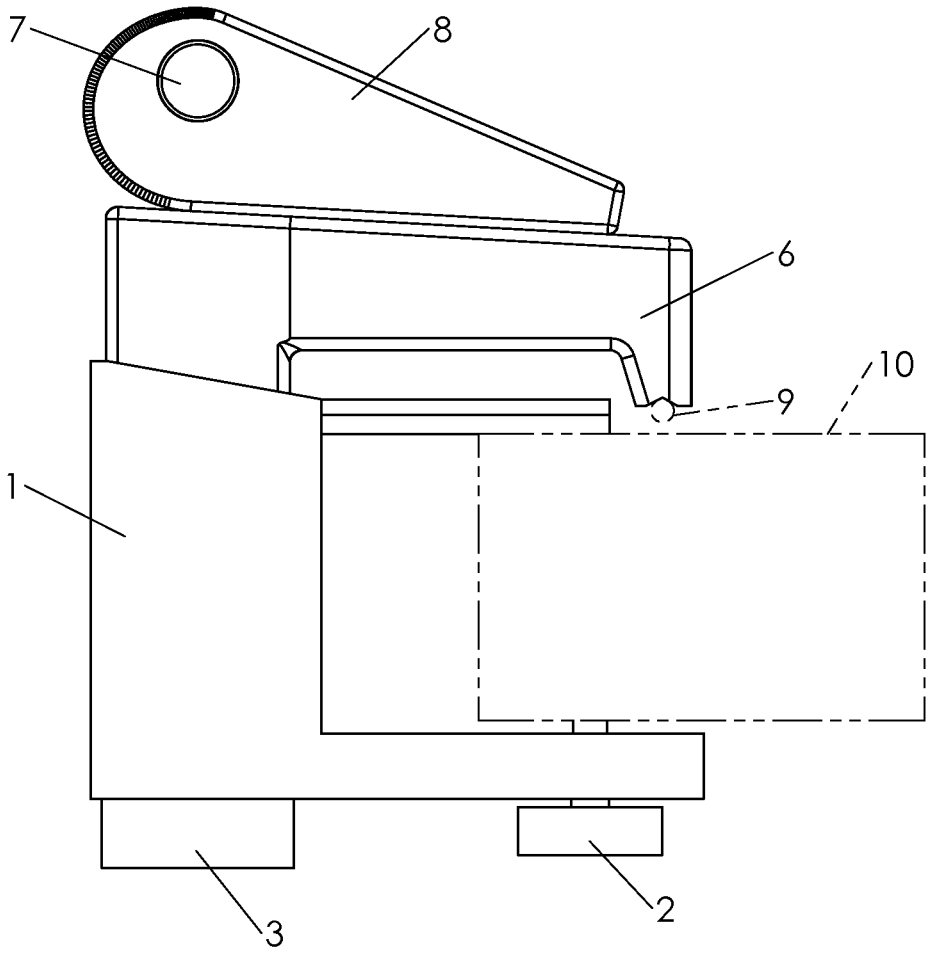
FIG. 4 is the same as FIG. 3 with the string deflected.

In operation one uses the mechanical pitch shifter to control the pitch of a string 9 on a musical instrument. FIG. 3 is a front view of the mechanical pitch shifter with base clamp 1 clamped to a headstock 10. The mechanical pitch shifter attaches to headstock 10 of the musical instrument by clamping force between the boss of base clamp 1 and thumbscrew 2. The mechanical pitch shifter is positioned on headstock 10 between the musical instrument's tuning mechanism and the end point of the string's free vibration such as the nut of a guitar. In FIG. 3 top bar 6 does not engage string 9 on the musical instrument and spring 5 forces top bar 6 away from base clamp 1. This force keeps top bar 6 in bearing with cam 8. In FIG. 3 string 9 is tuned to a desired lower pitch using the tuning mechanism on the musical instrument. FIG. 4 shows top bar 6 engaging string 9 to raise the pitch by deflecting string 9 and thereby increasing tension in string 9. Here cam 8 is at its highest point of lift. Adjustment to thumbwheel 3 changes the displacement between top bar 6 and base clamp 1. This in-turn changes the tension in string 9 to allow fine tuning to the desired pitch. To obtain the original pitch, cam 8 rotates to its lowest point of lift shown in FIG. 3.

There are many possibilities with regard to type of situations in which this mechanical pitch shifter would be of use. The basic function of the mechanical pitch shifter is to allow at least two different tuning of a string. Many different types of musical instruments can utilize such a device such as guitar and banjo. With individual fine tuning mechanisms attached to top bar 6, multiple strings can be retuned.

There are other ways by which the base clamp 1 can be attached to the musical instrument. Another way for attachment would be with a conventional torsional spring clamp (not shown). Other conventional attachment would be with adhesive (not shown) or a fastener (not shown).

Accordingly, it will be appreciated that the embodiments of a mechanical pitch shifter can be used to select the desired string pitch. This device can eliminate the need for permanent modification of a musical instrument. This devise can also be used on multiple instruments since it is simple to attach. Although the description above contains much specificity, this description should not be construed as limiting the scope of the invention but as merely providing illustrations of exemplary embodiments of this invention.

The invention claimed is:

1. A mechanical pitch shifter, comprising:

a base clamp with means for attachment to a musical instrument with strings, a top bar slidably disposed to said base clamp, a cam and cam handle pivotally supported in relation to said base clamp, whereby when said cam handle is urged to a lifted position cam bears against said top bar causing top bar to deflect at least one musical instrument string, at a position supported between two points beyond at least one musical instrument string operational length, thereby increasing pitch of said at least one musical instrument string.

2. The mechanical pitch shifter of claim 1, wherein said two points beyond said at least one musical instrument string operational length, is between a nut and a tuning post of said musical instrument.

3. The mechanical pitch shifter of claim 2, wherein said musical instrument is a banjo, guitar, or other stringed musical instrument.

4. The mechanical pitch shifter of claim 1, wherein said cam pivotally supported in relation to said base clamp, is adjustable by a thumbwheel bearing on said base clamp, pivotally supported in relation to a threaded rod disposed to said cam.

5. The mechanical pitch shifter of claim 1, wherein said means for attachment to a musical instrument is a torsion spring clamp.

6. A method of changing the pitch of at least one musical instrument string of a stringed musical instrument, comprising:

clamping a base clamp comprising a string clamping device having a cam and a handle to the stringed instrument at a position outside the string operational length, positioning said string clamping device adjacent said musical instrument string and an opposed musical instrument body surface, and urging said string clamping device cam via said cam handle to a clamped position, whereby pitch of said at least one musical instrument string is increased, urging said string clamping device cam via said cam handle from a further clamped position to an un-clamped position, whereby pitch of said at least one musical instrument string is decreased.

7. The method of changing the pitch of at least one musical instrument string of a stringed musical instrument of claim 6, wherein said two points beyond at least one musical instrument string operational length, is between a nut and a tuning post of said musical instrument.

8. The method of changing the pitch of at least one musical instrument string of a stringed musical instrument of claim 6, wherein said musical instrument is a banjo, guitar, or other stringed musical instrument.

* * * * *